US006075443A

United States Patent [19]

Schepps et al.

[11] Patent Number: 6,075,443

[45] Date of Patent: Jun. 13, 2000

[54] WIRELESS TETHER

[75] Inventors: Jonathan Lloyd Schepps, Princeton Junction; Anthony Robert Musto, Ringoes, both of N.J.

[73] Assignee: Sarnoff Corporation, Princeton, N.J.

[21] Appl. No.: 09/127,265

[22] Filed: Jul. 31, 1998

[51] Int. Cl.[7] ..... G08B 23/00

[52] U.S. Cl. ..... 340/573.4; 340/529; 340/572.1; 340/573.3; 340/825.69

[58] Field of Search ..... 340/573.4, 539, 340/529, 309.15, 568.1, 573.3, 505, 572.1, 825.34, 825.54, 825.69, 825.72

[56] References Cited

U.S. PATENT DOCUMENTS

| | | | |
|---|---|---|---|
| 3,568,161 | 3/1971 | Knickel | 340/992 |
| 4,334,221 | 6/1982 | Rosenhagen et al. | 340/825.72 X |
| 4,675,656 | 6/1987 | Narcisse | 340/573.4 X |
| 4,691,202 | 9/1987 | Denne et al. | 340/825.54 |
| 5,381,129 | 1/1995 | Boardman | 340/573.3 |
| 5,477,210 | 12/1995 | Belcher | 340/573.4 X |
| 5,491,482 | 2/1996 | Dingwall et al. | 342/42 |
| 5,502,445 | 3/1996 | Dingwall et al. | 342/51 |
| 5,512,879 | 4/1996 | Stokes | 340/573.4 |
| 5,565,850 | 10/1996 | Yarnall, Jr. et al. | 340/573.3 |
| 5,589,821 | 12/1996 | Sallen et al. | 340/573.4 |
| 5,596,313 | 1/1997 | Berglund et al. | 340/574 |
| 5,652,569 | 7/1997 | Gerstenberger et al. | 340/573.4 |
| 5,661,460 | 8/1997 | Sallen et al. | 340/573.4 |
| 5,689,240 | 11/1997 | Traxler | 340/573.4 |
| 5,714,932 | 2/1998 | Castellon et al. | 340/573.4 X |
| 5,754,121 | 5/1998 | Ward et al. | 340/573.7 X |
| 5,769,032 | 6/1998 | Yarnall, Sr. et al. | 340/573.3 X |
| 5,771,002 | 6/1998 | Creek et al. | 340/539 |

OTHER PUBLICATIONS

"TrackIT Portable Anti–Theft System", product package card, TrackIT Corp. (2 sheets).

"Mobile Security Goes High Tech", TrackIT Corp., Internet "http://www.trackitcorp.com/", Copyright 1997 (2 sheets).

Data Sheet: Holtek $2^{12}$ Series Encoders, pp. 1–14, 1996.

Data Sheet: Holtek $2^{12}$ Series Decoders, pp. 1–7, 1996.

"RF puts a lock on your computer," Automatic I.D. News, Jul. 1998, p. 10.

"Ensure Technologies—PC and Laptop Automatic Full–Time Access Security" (http://www.ensuretech.com), Copyright 1998 (10 pages).

FCC OET Search Form (1 sheet) and FCC Form 731 (4 sheets): Grantee K5I–Huge Automations Co. Ltd. (https://gullfoss.fcc.gov), 1998.

*Primary Examiner*—Thomas Mullen
*Attorney, Agent, or Firm*—William J. Burke

[57] ABSTRACT

A wireless tether serves to warn if a tethered article moves away from the tethering location, such as a child moving away from a parent, or luggage being removed from its owner, or equipment being removed from a facility. A transmitting module on each tethered article periodically transmits a low power identification signal including a coded value. A receiving module at the tethering location receives identification signals transmitted by the transmitting module (s) and compares the coded value thereof to a stored coded value predetermined to correspond to that of the particular tethered article. If there is correspondence, the tethered article is near the tethering location. If there is not correspondence within a predetermined time interval, the tethered article has moved away and an alarm is raised. The "length" of the tether is adjusted by adjusting the transmission range of the transmitting module to the receiving module. A number of non-correspondences may be permitted before raising the alarm so as to reduce false alarms. A receiving module can tether plural transmitting modules and may be arranged for such plural transmitter modules to have identification signal coded values that are the same, or that are partially or completely different.

34 Claims, 7 Drawing Sheets

WIRELESS TETHER

The present invention relates to detection of coded articles and, in particular, to detecting when a particular coded article is not present.

The losing and misplacing of things has been a problem probably since the beginning of history. In modern society, the problem is compounded by the availability of easily transportable articles of great value. A traveler may lose or forget his luggage. A portable computer may be left behind or stolen. A child may wander away from its parents. Office equipment may be removed. A conventional approach of a physical tether, such as a rope, strap, leash or chain is simply not practical in many environments.

Modern electronic security systems also have disadvantages. Burglar alarms and theft alarms most often require substantial installation of electronic devices in the facility to be monitored or in the article to be protected or both. One example of this is the "electric fence" which is used to restrain pets or animals from leaving a particular piece of property. An electric fence operates by a wire that is buried around the perimeter or boundary of the area in which the animal is to be contained. A radio transmitter is coupled to the buried wire and the animal is fitted with a collar including a radio receiver. When the animal approaches the wire, the radio signal is detected by the receiver on the animal's collar and is used to generate a noise or to electrically shock the animal to stop it from approaching any closer to the boundary. Aside from the inflexibility associated with a buried wire, such system is inhumane for use with children.

Accordingly, there is a need for a wireless tethering system that is easily portable and flexible and that is suitable for use with human beings as well as with animals and inanimate objects. In addition, there are needs for wireless tethers that are operable for tethering a plurality of articles, and for wireless tethers that are operable in an environment in which a plurality of similar wireless tethers are operating.

To this end, the present invention comprises a coded article transmitting an identification value and a receiver for receiving the identification value. The receiver includes a detector generating a first signal when the identification value corresponds to a predetermined value and a timer responsive to the first signal to generate an alarm when the first signal is not generated for a predetermined timer interval.

DESCRIPTION OF THE PREFERRED EMBODIMENT

Figure 1:
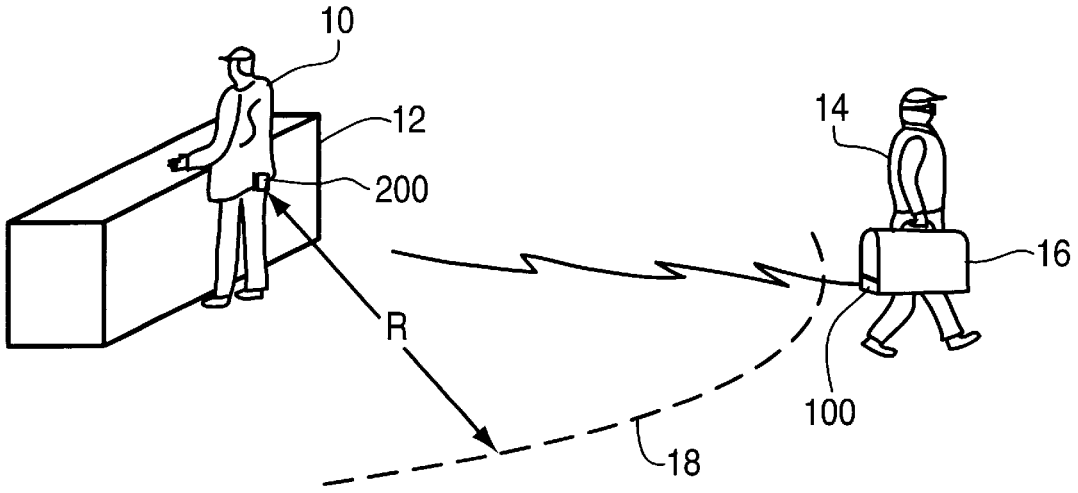
FIG. 1 is a schematic diagram including an embodiment of a wireless tether in accordance with the present invention including a transmitter module and a receiver module.

In FIG. 1, a wireless tether is depicted in the context of protecting a portable article. A person 10 is engaged at counter 12, such as by being involved in a transaction taking place there. Thief 14 has picked up the luggage 16 of person 10 and is stealing it. Person 10, however, has placed in his luggage 16 a transmitter module 100 which periodically transmits a coded identification signal including a coded value. This low-power transmitted identification signal has a limited transmission range R. Person 10 has on his person, receiver module 200 which includes a receiver for receiving a coded identification signal and if that coded identification signal is present, receiver 200 is satisfied and takes no action. So long as transmitter module 100 and receiver module 200 are within the transmitter range R of each other, e.g., so long as luggage 16 including transmitter module 100 is within range boundary 18, the identification signals transmitted by transmitter module 100 will be received by receiver module 200 and will be detected as being present.

When, however, thief 14 removes luggage 16 further than the range boundary 18, receiver module 200 will no longer receive the identification signal being transmitted by transmitter module 100. This lack of identification signal is detected in receiver module 200 and, if it persists for a predetermined length of time, will cause an alarm in receiver module 200 to be initiated. The alarm could include an audible alarm or a visual alarm, such as a flashing light, or it may activate a vibrator, any one of the foregoing being sufficient to alert person 10 that his luggage 16 is being removed.

It is noted that the identification signal transmitted by transmitter module 100 includes a particular coded value which is predetermined for that transmitter module, i.e. it is a value that has been preset by the manufacturer or by the user. Receiver module 200 has been preprogrammed with that identical coded value and so receiver module 200 will detect the presence only of transmitter module 100 which has stored therein the coded value corresponding to that stored in the receiver module, i.e. the one that has been preset by the manufacturer or by the user. This requirement for a correspondence of preset identification signal coded values provides an added measure of security because receiver module 200 will only detect transmitter module 100; it will not respond to a different transmitter as could easily happen where the coded value is not fixed but is established when the receiver is initialized by a value received after it is first turned on. If the coded value of the receiver is established when it is turned on, the receiver could respond to a nearby transmitter other than the one associated with the user of that receiver. Preset coded values further provide the capability for multiple wireless tethers including multiple transmitter-receiver sets to be employed in close proximity to each other owing to the relatively large number of different preselected coded values that may be established for each transmitter-receiver set.

Figure 2:
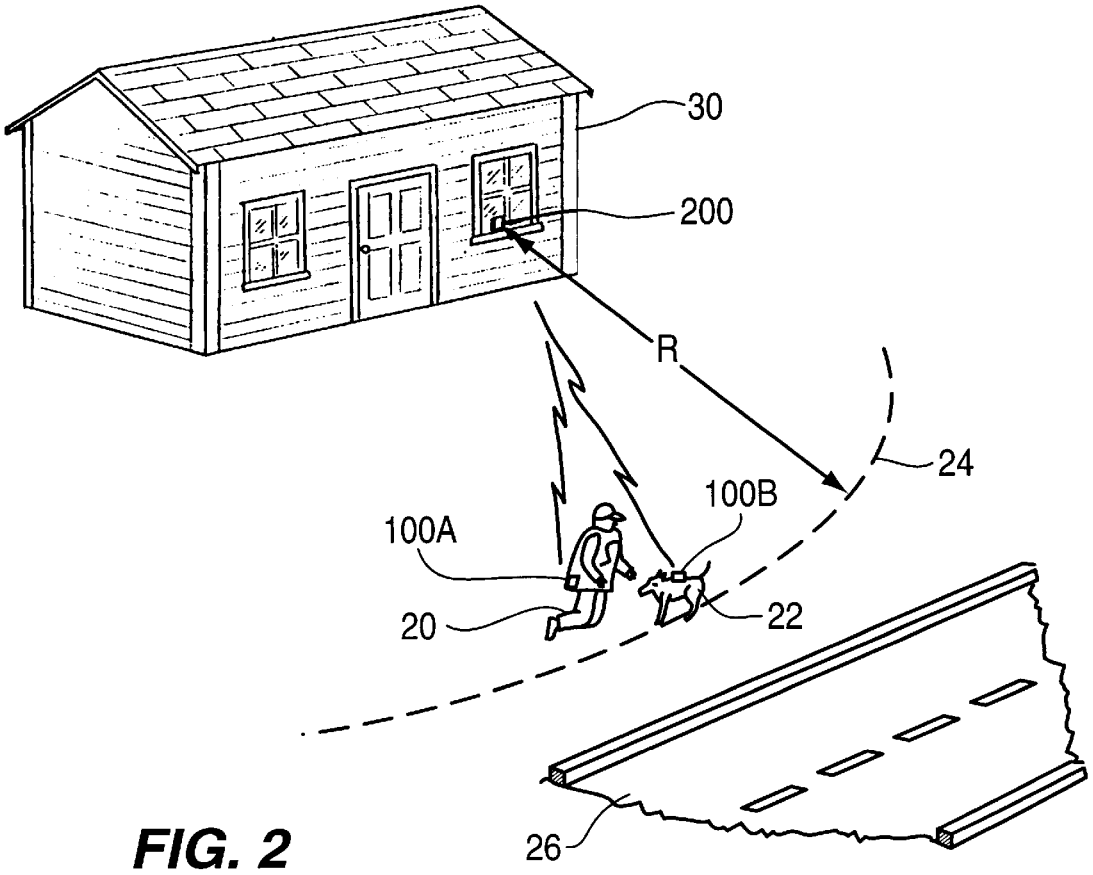
FIG. 2 is a schematic diagram including an embodiment in accordance with the present invention employing plural transmitter modules.

In FIG. 2 is shown an embodiment of a wireless tether including two transmitter modules 100A, 100B and receiver module 200. Transmitter module 100A is carried by child 20 and is in radio frequency communication with receiver module 200 so long as child 20 is within transmitter range R. If child 20 crosses over the transmitter range R boundary 24, for example, as to go near the dangerous roadway 26, transmitter module 100A and receiver module 200 are no longer within transmission range R and receiver module 200 detects the absence of the transmitted identification signal coded value from transmitter module 100A and sounds an alarm in house 30. Similarly, transmitter module 100B which has a different identification signal coded value from that of transmitter module 100A, is attached to dog 22 and in communication with receiver module 200. If dog 22 goes beyond range boundary 24 and thus out of transmitter range R between transmitter module 100B and receiver module 200, then receiver module 200 detects the absence of the identification signal coded value from transmitter module 100B and sounds the alarm in house 30.

Receiver module 200 receives identification signals including different preselected coded values from each of transmitter modules 100A, 100B. It is preferred that the identification signals of transmitter modules 100A, 100B include different coded values including the same address value, but with different data values, thereby providing a unique identification for each particular transmitter module. Receiver module 200 receives and requires detection of the identification signals from both transmitter modules 100A and 100B within a given time. Receiver module 200 can be configured to require detection of both of the two coded values associated respectively with the two identification signals or it can be configured to require detection of two identification signals within a particular range of values of the coded value associated with the identification signal.

Transmitter modules 100A and 100B may operate contemporaneously with a single receiver module 200 and in a communication space with other transmitter-receiver sets by employing a variety of communications techniques to avoid collisions of their communication transmissions. Such techniques include, for example, transmitter modules transmitting on different frequencies and transmitter modules transmitting only for a relatively small portion of a transmission period. In the latter case, a number of transmitters each operating at a relatively low transmission duty cycle within the same communication space will have a high probability of successfully communicating without repeated collisions. Where each transmitter transmits a 50 millisecond transmission every five seconds, for example, there is only a one percent transmission duty cycle and a correspondingly low probability of a transmission collision. To this end it is noted that it is preferred that the timer circuits in transmitter modules 100A and 100B that control the time interval between successive transmissions not be high precision timers, but that there be a range of tolerances in the time intervals between transmissions from the various transmitters thereby to reduce the probability of repeated collisions between successive transmissions.

Accordingly, the wireless tether includes two components: a radio frequency transmitter module 100 carried on the child and a compatible receiver module 200 in the possession of or proximate a responsible person, e.g., an adult. Every few seconds, the transmitter module sends out a preselected identification signal coded value and every few seconds the receiver module 200 expects to receive this preselected coded value. If the receiver 200 does not receive this identification signal coded value within a specified or predetermined time period, an alarm is sounded. By controlling the communication range between a transmitter 100 and receiver 200, the wireless tether of the present invention provides a zone 24 within which the alarm of receiver 200 will remain silent so long as receiver 200 is detecting the presence of a proper transmitter, i.e., a transmitter 100 having the same coded value as that receiver. The receiver module 200 will sound its alarm under any of the following conditions: (1) transmitter module 100 has moved out of transmission range from the receiver, (2) transmitter module 100 failed to transmit the expected identification signal coded value, (3) receiver module 200 failed to receive the expected identification signal coded value, or (4) transmitter module 100 failed to operate. In a wireless tether arrangement where plural transmitters 100A, 100B are employed with a single receiver module 200, each transmitter module 100A, 100B would send a unique identification signal coded value. The receiver module 200 would require that all the programmed transmitter signal coded values be received within a certain period of time, otherwise an alarm would sound.

Figure 3:
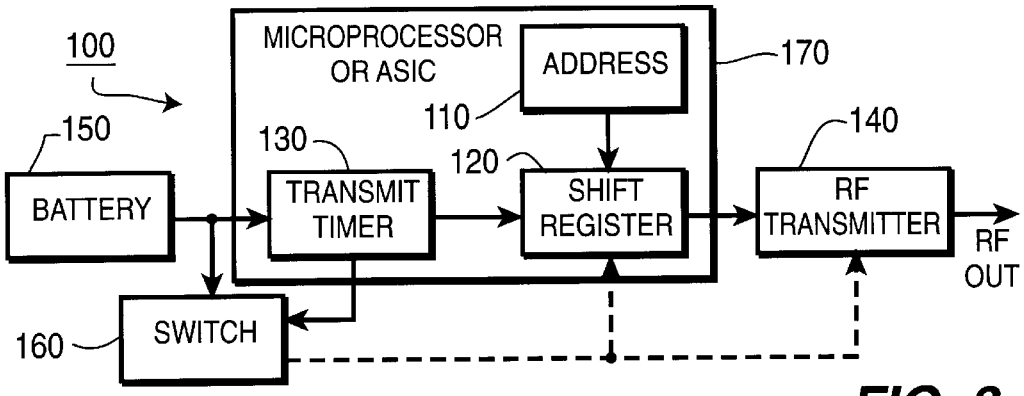
FIG. 3 is a schematic block diagram of a transmitter module in accordance with the present invention.

FIG. 3 is a schematic block diagram of transmitter module 100. Storage memory 110 includes a stored address or coded value, for example, in parallel bit format, that is a preselected coded value associated with the particular transmitter module 100. Storage device 110 applies the address coded value to an encoder, such as shift register 120 which when enabled encodes the coded value by converting it from parallel bit format to serial bit format which is applied to radio frequency (RF) transmitter 140. Radio frequency transmitter 140 modulates the coded value which is encoded in serial bit format onto a radio frequency carrier signal which is transmitted as an RF output signal (RF Out) such as via a simple loop antenna.

In order to reduce the electrical power consumption of transmitter module 100, address storage 110, shift register 120 and RF transmitter 140 are only powered for a short period of time when the identification signal coded value is to be transmitted. To this end, transmit timer 130 periodically, for example, once every four seconds, activates switch 160 to connect electrical power from battery 150 to address storage 110, shift register 120 and RF transmitter 140 as is indicated by the dashed lines of FIG. 3. Battery 150 is continuously connected to transmit timer 130 so that transmit timer 130 can periodically enable switch 160 and therefore cause transmitter module 100 to periodically transmit its identification signal coded value.

Transmitter module 100 may be implemented in various electrical technologies that are known to those of skill in the art, such as by discrete electronic circuits or integrated circuits. An implementation employing a microprocessor or an application specific integrated circuit (ASIC) 170 is shown diagrammatically in FIG. 3.

Figure 4:
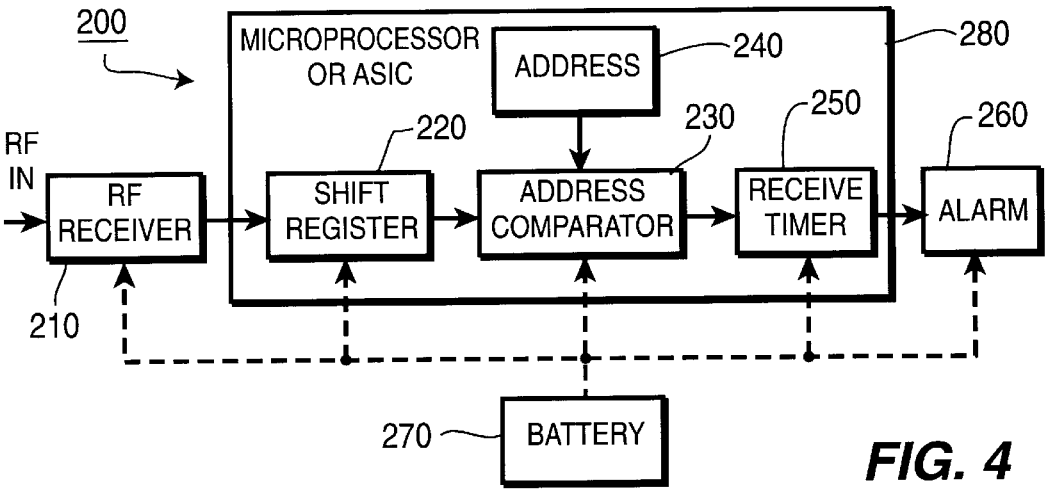
FIGS. 4 and 5 are schematic block diagrams of receiver modules in accordance with the present invention.

FIG. 4 is a schematic block diagram of receiver module 200 which operates in conjunction with transmitter module 100 as previously described. Radio frequency identification signals transmitted by transmitter module 100 are input signals (RF In) to RF receiver 210 as may be captured by a simple loop antenna (not shown). Identification signals received by RF receiver 210 are applied to a decoder, such as shift register 220 which converts the coded value therein from a serial bit format to a parallel bit format. Address comparator 230 receives at one input the transmitter module coded value in parallel bit format from shift register 220 and at its other input a preselected fixed stored coded value from address storage 240. The preselected coded value from address storage 240 corresponds to the preselected coded value of the transmitter module 100 with which receiver module 200 is associated. In other words, the preselected coded value stored in transmitter address storage 110 of transmitter module 100 is the same preselected coded value as is stored in address storage 240 of receiver module 200 with which it is associated. If the coded value in the received identification signal matches the preselected fixed coded value stored in address storage 240, this coincidence is detected by address comparator 230 and is applied to restart or reset receive timer 250. Receive timer 250 has a time-out period of, for example, six seconds and, if it is not restarted or reset within six seconds, it produces a signal to initiate alarm 260. Address storage 240 is preferably a non-volatile memory device so that the fixed reference coded value stored therein is fixed even though the receiver module 200 is turned off or its battery becomes drained.

In operation, if transmitter module 100 is within transmission range R of receiver module 200 and transmits its particular identification signal coded value every four seconds, then receive timer 250 in receiver module 200 will be restarted every four seconds and will not reach the six second time-out period and initiate alarm 260. When the particular coded value from transmitter module 100 is not received, however, comparator 230 of receiver module 200 will not detect correspondence between a received identification signal coded value and the coded value stored in address storage 240 and so will not restart receive timer 250 which will then initiate alarm 260. Each of the functional elements 210–260 of receiver module 200 receive electrical power from battery 270 as shown by the dashed lines in FIG. 4.

It is noted that receiver module 200 will sound alarm 260 whenever an identification signal containing the corresponding coded value is not received. This can occur not only when transmitter module 100 moves beyond transmitter range R from receiver module 200, but also when the battery in transmitter module 100 is drained or upon any other condition that prevents transmitter module 100 from properly transmitting its coded value or that prevents receiver 200 from receiving and properly decoding that coded value. This condition is an asset in that it tends to provide a "fail-safe" arrangement of the transmitter-receiver set, which set includes the transmitter module 100 and the receiver module 200.

For applications employing plural transmitter modules 100, the decoder 230 of receiver module 200 is configured to accept either (1) a range of valid addresses from the set of transmitter modules 100 or (2) any valid address from a list of valid addresses stored in address store 240. In the first case, each transmitter module 100 within a group of transmitter modules associated with a particular receiver module 200 would be configured to have a coded value with the same address bits, but with unique data bits. The receiver module 200, upon detecting a proper address bit sequence of the coded value, decodes the data bits thereof and sets a latch selected by those particular data bits. A number of latches, one for each transmitter module 100 associated with that receiver module 200, must be set within the time out interval of receive timer 250 or the alarm 260 will be activated. In the second case, the receiver module 200 stores a list of specific coded values, i.e. valid addresses, in a memory, such as memory 240, and as transmitted addresses are received, they are compared to the valid addresses in the list stored in address block 240. The alarm 260 is activated if address values corresponding to all of the stored valid addresses are not received within the time-out interval of receive timer 250.

Similarly to transmitter module 100 described above, receiver module 200 may be implemented in various technologies, including a microprocessor or ASIC 280.

While a nominal transmit interval of four seconds has been described for transmitter module 100 and a nominal receive timer interval of six seconds has been described for receiver module 200, the selection of the respective timer intervals may vary depending upon the application to which the wireless tether will be put, the degree of security desired, and the need for prompt detection of the distance between the transmitter module and receiver module exceeding the transmission range R. The range of time for the timer interval between transmissions may be, for example, between one second and 10 seconds. In a wireless tether intended to monitor a child's movements, a shorter time may be preferred. In one intended to monitor the movement of a large article, such as a photocopy machine, a longer time is acceptable. With respect to receiver module 200, the receive timer 250 interval is preferably in the range between about 1.5 and four times the time interval between successive transmissions of an identification signal coded value by transmitter 100. Where the receiver time-out interval exceeds about two times the transmitter 100 transmission interval, it allows for detection of a correct transmitted identification signal coded value over a number of transmitter 100 transmission intervals (e.g., two transmission intervals) to indicate that the receiver module 200 is in an appropriate location. Thus, the receiver 200 need only successfully receive and detect one out of every two transmitted identification signal coded values, thereby decreasing the likelihood of a false alarm. It is noted that the likelihood of a false alarm would be greater if the receive timer interval were established to require successful receipt of the corresponding coded value during each and every transmission interval.

Figure 5:
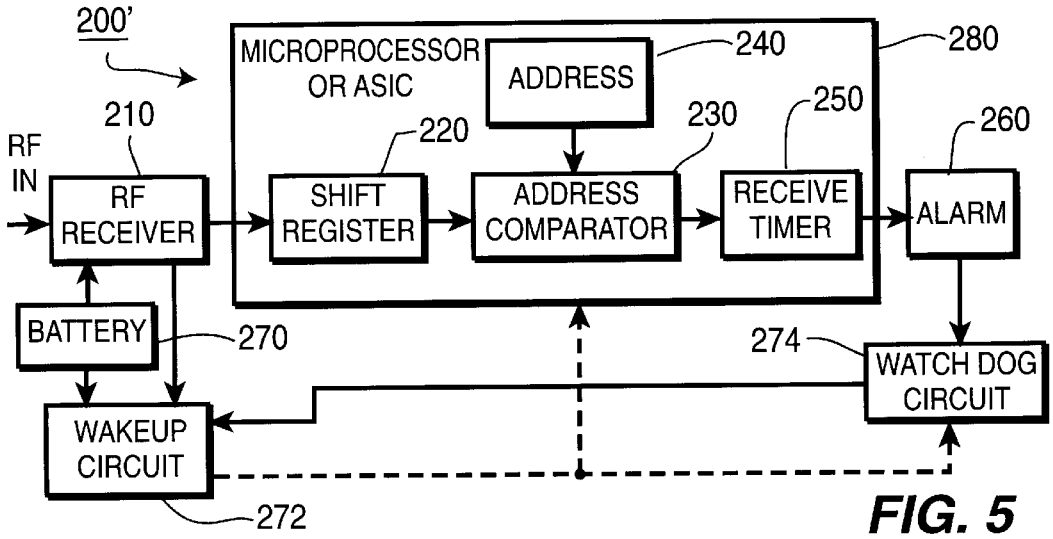

FIG. 5 is a schematic block diagram of a modified receiver module 200' in which a battery 270 continuously powers RF receiver 210 and a wake-up circuit 272, but not the remaining blocks 220–274 thereof. When an RF signal is received by RF receiver 210 it signals wake-up circuit 272 which then applies electrical power from battery 270 to the remainder of receiver module 200' as is indicated by the dashed lines in FIG. 5. Wake-up circuit 272 maintains electrical power from battery 270 to all of receiver module 200' for a time interval that is at least as long as the time-out interval of receive timer 250 plus the desired time for alarm 260 to sound. To prevent unintended sounding of alarm 260 for a long period of time, a watch dog circuit 274 may be employed. When powered by wake-up circuit 272, watch dog circuit 274 monitors the sounding of alarm 260 and, if alarm 260 sounds for a sufficiently long time as to, for example, endanger substantially draining battery 270, then watch dog circuit 274 turns off wake-up circuit 272. In all other respects, the operation of shift register 220, address comparator 230, address storage 240, receive timer 250 and alarm 260 of modified receiver module 200' is like that described above in relation to receiver module 200.

Figure 6:
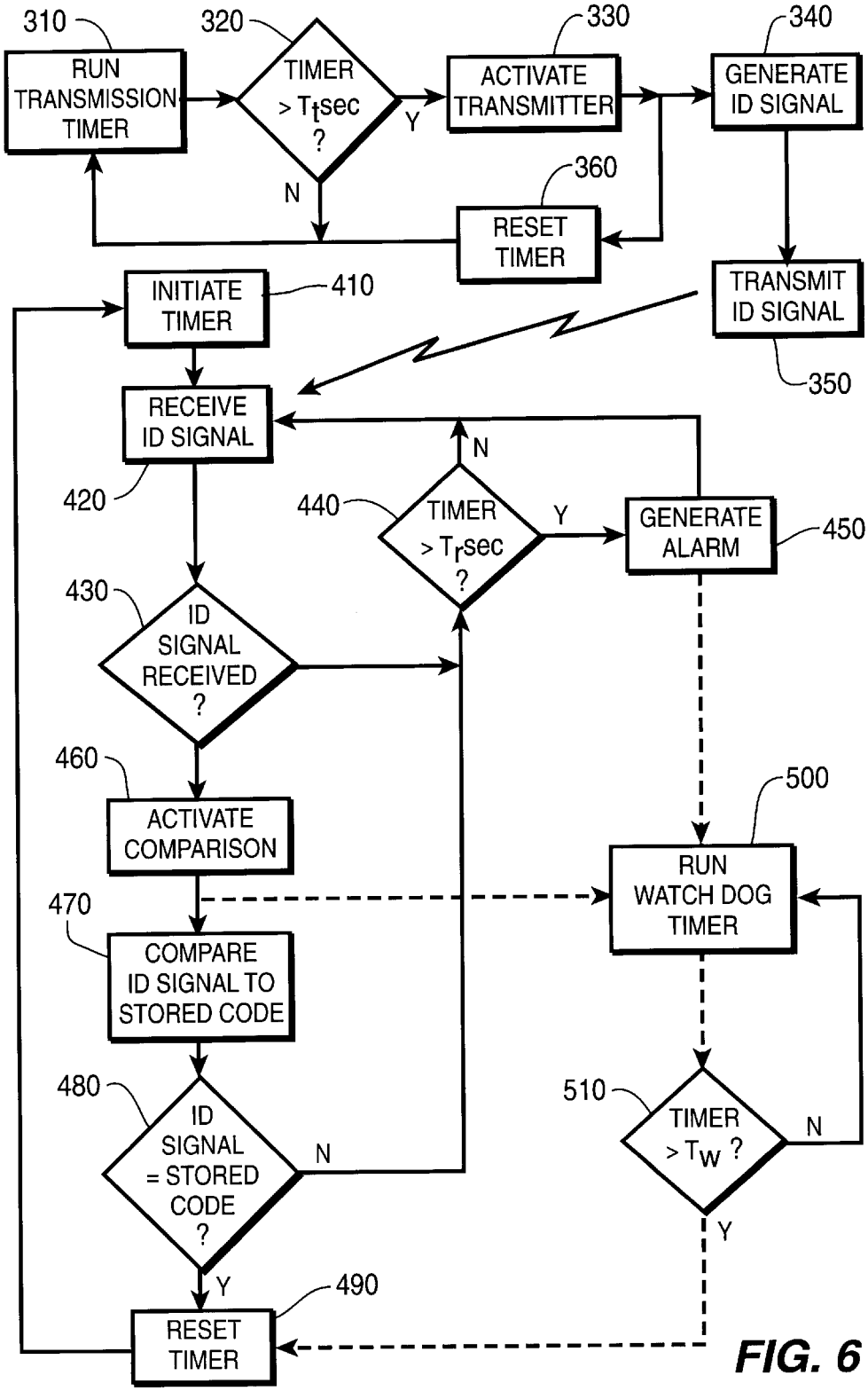
FIG. 6 is a signal flow diagram relating to the present invention.

FIG. 6 is a flow diagram depicting the operation of transmitter module 100 and receiver module 200. First, the transmission timer is run 310 and is monitored by decision block 320. If the transmission timer time does not exceed the transmission time interval $T_t$ seconds, decision block 320 is exited by the "no" path and the transmission timer continues to run 310. If the transmission timer time exceeds the time-out interval of $T_t$ seconds, the transmitter is activated 330 to generate 340 the identification signal including the coded value and to transmit 350 that identification signal. At that time the transmission timer is reset 360 to again run 310, whereby an identification signal is periodically transmitted, e.g., every $T_t$ seconds.

In the receiver module, the receive timer is initiated 410 while waiting to receive 420 an identification signal including a coded value. If such identification signal is not received 430, then the process exits decision block 430 at the "no" path and decision block 440 tests the receive timer to determine whether a receive timer time period $T_r$ seconds has been exceeded. If the receive time interval $T_r$ seconds has been exceeded, the process exits decision block 440 by the "yes" path to generate an alarm 450. If the receive timer time-out interval $T_r$ seconds has not been exceeded, the process exits decision block 440 along the "no" path to again receive 420 an identification signal. If an identification signal is received, decision block 430 is exited via the "yes" path to activate comparison 460 to compare 470 the received identification signal coded value to the stored coded value of the receiver module. If the coded value of the received identification signal does not equal the coded value stored in the receiver module, decision block 480 is exited by the "no" path to again test for the completion of receive time-out interval $T_r$ in decision block 440 as previously described. If decision block 480 determines that the coded value of the received identification signal equals the coded value stored in the receiver module, decision block 480 is exited by the "yes" path to reset 490 the receive timer and reinitiate 410 that timer, and the process continues as previously described.

FIG. 6 also includes a run watch dog timer 500 function block which monitors the alarm generated 450 and compares the time that an alarm has been generated to a watch dog timer interval $T_w$. If the alarm time does not exceed time $T_w$, decision block 510 is exited by the "no" path to continue to run watch dog timer 500 and allow the alarm to sound. If the alarm time exceeds the watch dog time period $T_w$, decision block 510 is exited via the "yes" path to reset the timer 490 and reinitiate the timing period 410 whereupon the process continues or repeats as previously described.

In an embodiment employing plural transmitter modules such as that described above in relation to FIG. 2, each coded value preferably includes an address portion and a data portion. The address portions of the coded values of transmitters 100A, 100B are the same value and are the same as the address portion of the coded value stored in address storage 240 of receiver module 200. The respective data portions of the coded values of transmitter modules 100A, 100B differ and those respective data values are stored in address storage 240. With reference to FIG. 3, the comparison 470 of each identification signal coded value is performed for the address portion thereof and if decision block 480 determines that address value to be equal to the stored address portion stored in the receiver module 200, then the data portion of that coded value is stored. The stored data portions of the received identification signal coded values are compared to a list of data portions stored in address storage 240. If data portions corresponding to all of the data portions stored in that stored list have been received, i.e. proper coded values corresponding to all associated transmitters have been received within the receive timer interval $T_r$ seconds, then decision block 480 is exited by the "yes" exit path to reset 490 the receive timer as described above. If data portions corresponding to all the data portions stored in that list have not been received, i.e. all associated transmitters are not accounted for within the receive timer interval $T_r$ seconds, then decision block 480 is exited by the "no" path and an alarm will be generated 450 if the receive timer interval has expired 440, as described above.

Figure 7:
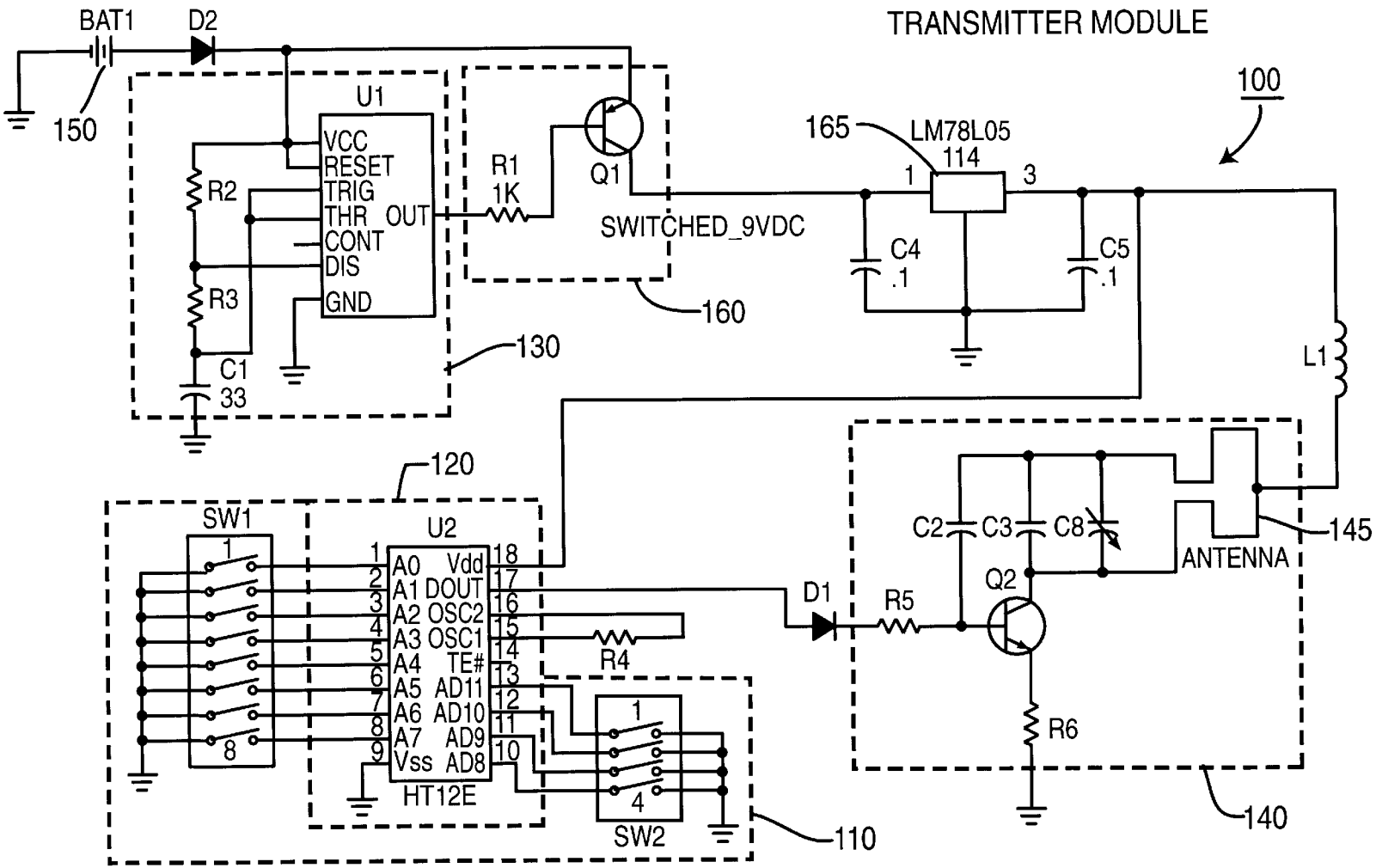
FIG. 7 is an electrical schematic diagram of a transmitter module in accordance with the present invention.

FIG. 7 is an electrical schematic diagram of an exemplary embodiment of transmitter module 100. Battery 150, for example, a nine-volt battery supplies electrical power via diode D2 to the transmit timer U1, such as an integrated circuit one-shot multivibrator type LM555 available from National Semiconductor Corporation. The time-out interval of multivibrator U1 is established by resistors R2, R3 and capacitor C1 which are preferably not high precision components. The periodic output from Up is applied to a transistor Q1 switch 160 which applies electrical power from battery 150 to a five-volt voltage regulator such as a type LM78L05 also available from National Semiconductor Corporation. Regulated voltage from regulator U4 is applied to shift register 120 address 81 and RF transmitter 140. Shift register 120 is implemented by an encoder integrated circuit U2 such as a 212 series encoder type HT12E available from the Holtek Microelectronics located in Hsinchu, Taiwan, R.O.C. Non-volatile address storage 110 is implemented by twelve single pole switches in switch packages SW1 and SW2 which are set to produce a twelve-bit coded value which is applied in parallel bit format to encoder integrated circuit U2 of shift register 120. Once set by the manufacturer or the user, the preselected coded value stored in address storage 110 is fixed and will not change absent human intervention. Integrated circuit U2 produces that preselected coded value in pulse-width-modulated serial-bit format and applies it through diode D1 to RF transmitter 140. RF transmitter 140 includes a class B biased transistor Q2 in an L-C tuned RF oscillator transmitter coupled to a loop antenna 145 for transmitting the identification signal coded value produced by encoder U2.

Transmitter module 100 need only employ a small antenna such as a small loop antenna and is not required to have optimum antenna coupling. In a typical embodiment, with a transmitter frequency of about 915 MHZ, a transmitter peak power output of less than or equal to one milliwatt produces a transmission range R of about thirty feet. Other frequencies and power levels may also be employed. The low transmitter power is advantageous in that it allows the size of transmitter module 100 to be relatively small so that it could be packaged into a device conveniently attached to a person or placed in luggage or affixed to other objects to be monitored. Similarly, a low transmission duty cycle, for example, 50 milliseconds out of every five seconds, also reduces power consumption, as does the utilization of low-power CMOS circuitry, further to reduce the capacity and size of the battery. The same size and packaging considerations apply with respect to receiver module 200.

Transmitter modules 100 and receiver modules 200 are preferably packaged in a small package such as that conventionally used for electronic remote controls for locking and unlocking automobile door locks and so may be conveniently attached by straps or worn on a necklace or may be conveniently carried in a pocket or stored in luggage or a portable computer.

Figure 8:
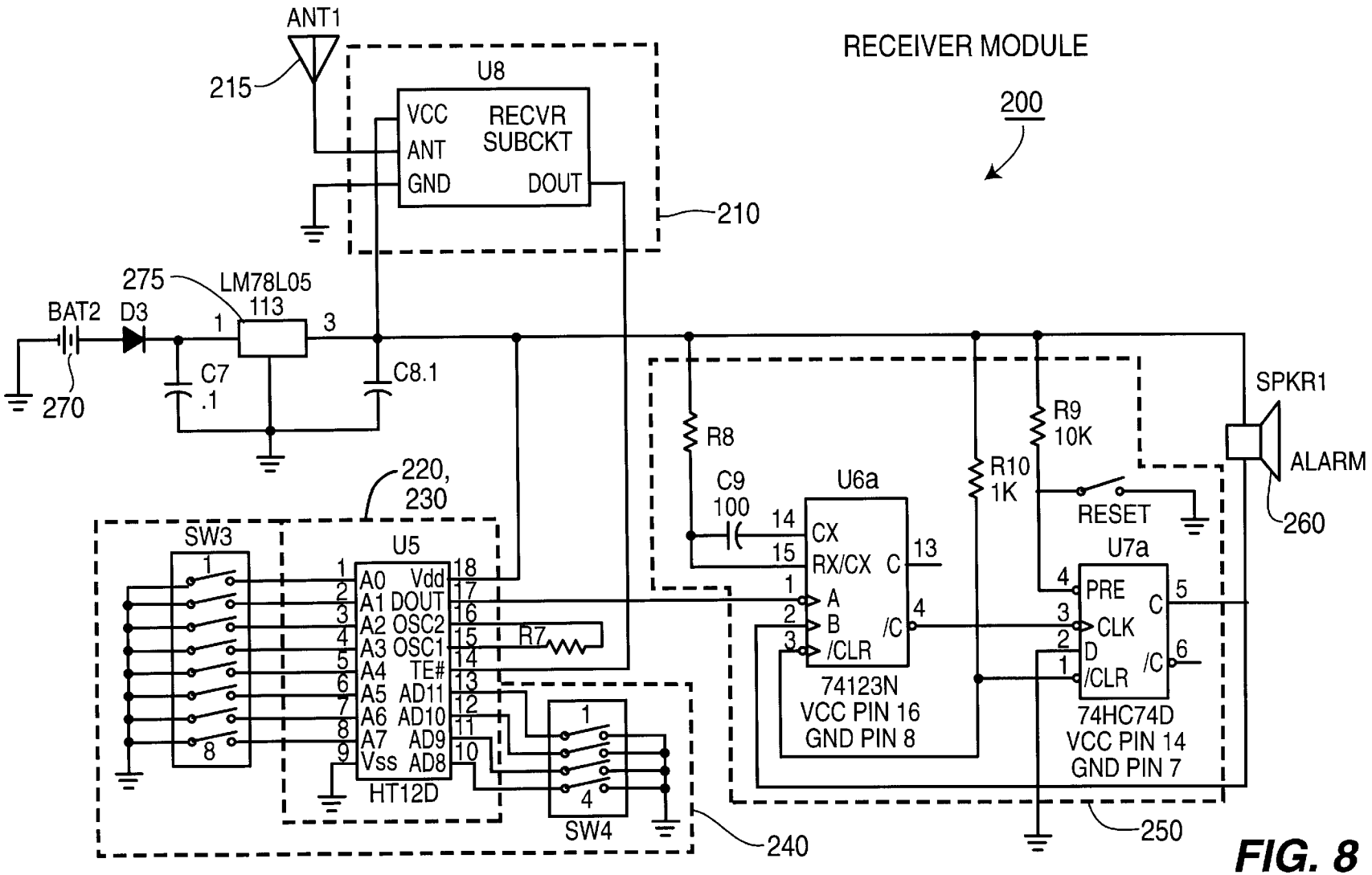
FIG. 8 is an electrical schematic diagram of a receiver module in accordance with the present invention.

FIG. 8 is an electrical schematic diagram of an exemplary embodiment of receiver module 200. Identification signals transmitted from transmitter modules are received at loop antenna 215 and applied to RF receiver 210 including a receiver sub-circuit integrated circuit U8 such as type RX-2010 available from RF Monolithics located in Dallas, Tex. The identification signal, including the twelve bit coded value in serial-bit format is coupled from the output of receiver sub-circuit U8 to shift register decoder and address comparator 220, 230 which are implemented in an integrated circuit US, such as a 212 series decoder type HT12D also available from the Holtek Microelectronics. Decoder US converts the coded value in serial-bit format to parallel-bit format and compares that received coded value to the preselected stored coded fixed reference value in parallel bit format determined by the positions of the twelve single pole switches in switch packages SW3, SW4 of non-volatile address storage 240.

In a transmitter-receiver set, the switch positions of the twelve switches SW1, SW2 of transmitter module 100 correspond to the switch positions of the corresponding twelve switches SW3, SW4 of receiver module 200, thereby storing the same preselected coded value in transmitter module 100 and its associated receiver module 200. These preset values are fixed and do not change absent human intervention. The twelve-bits available for storing coded values may be apportioned in a convenient way, for example, into an address portion and into a data portion, however, in a wireless tether employing a single transmitter module and single receiver module, the switches in each would normally be set to the same coded value. In a wireless tether employing plural transmitter modules 100A, 100B, and so forth, operating with a single transmitter module 200, the twelve-bit coded value can be apportioned, for example, into a ten-bit address portion and a two-bit data portion, which would accommodate up to four transmitter modules. The ten-bit address portion, for example, the ten most significant bits, would be identical for all the transmitter modules 100A, 100B, however, each transmitter module would have a different data portion contained in the two least significant bits. The receiver module 200 would then be arranged to require the reception of the coded values from each transmitter module during each receive timer 250 interval, such as by storing and comparing the two least significant bit data portions of each coded value to a stored list of coded value data portions for the associated transmitters 100A, 100B to determine whether each of the associated transmitter modules are within transmission range R.

Returning to FIG. 8, receive timer 250 of receiver module 200 is implemented by one-shot timer integrated circuit U6*a* such as type 74123N and D-flip flop U7*a* such as type 74HC74D, both of which are available from National Semiconductor Corporation of Santa Clara, Calif. When comparator 230 detects a match between the received coded value from transmitter module 100 and the coded value stored in address storage 240 it resets one-shot timer U6*a*. If one-shot timer U6*a* is not again reset within the time determined by timing resistor R8 and timing capacitor C9, U6*a* then sets flip-flop U7*a* and its Q output becomes low thereby applying voltage to loudspeaker alarm 260 to sound the alarm. Voltage from 9 volt battery 270 is regulated by voltage regulator circuit U3 such as type LM78L05 to produce a regulated +5 volt power supply for the functional blocks of receiver module 200.

Figure 9:
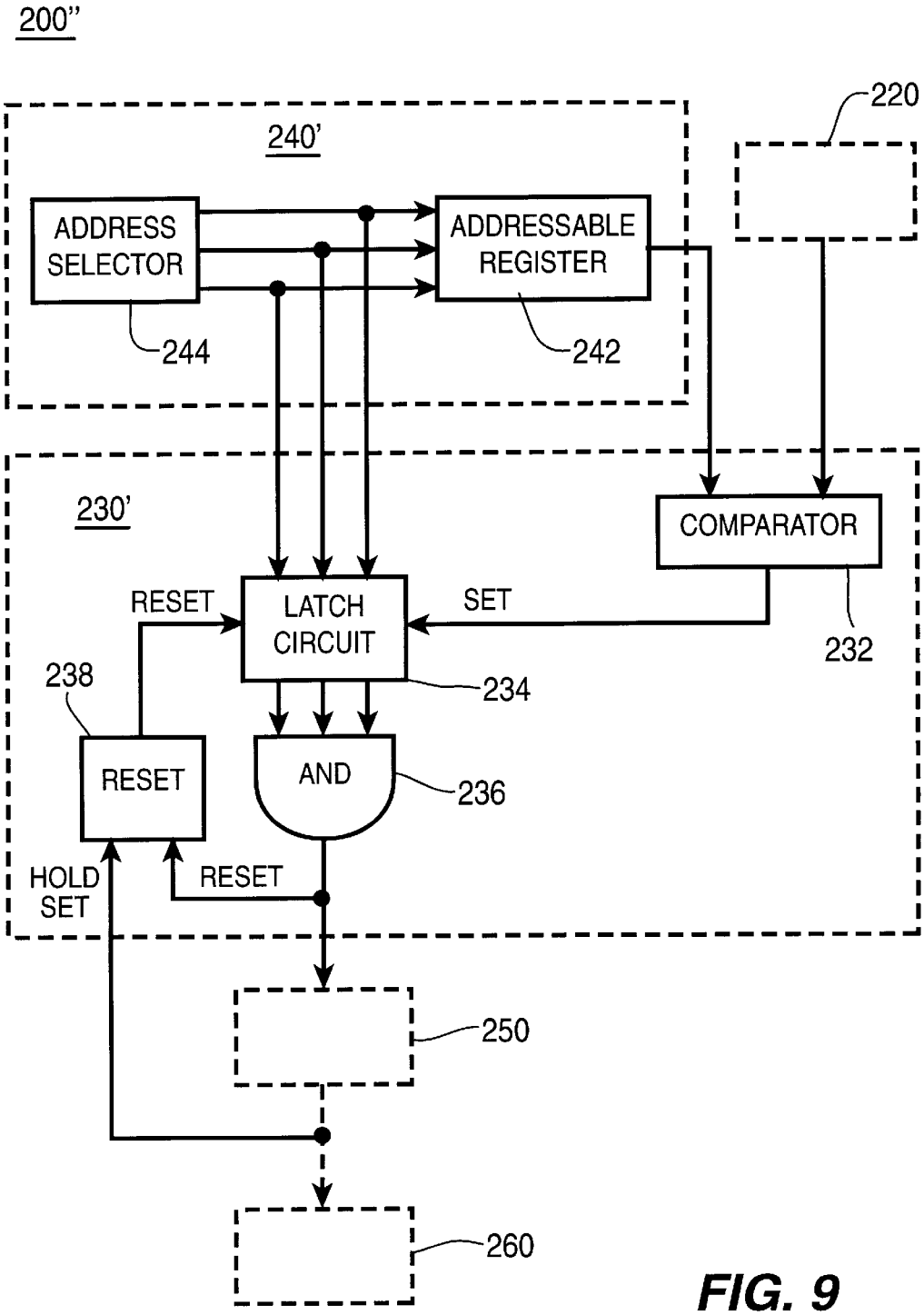
FIG. 9 is a schematic block diagram of an alternative embodiment of a portion of a receiver module in accordance with the present invention.

FIG. 9 is a schematic block diagram of a portion of a receiver module 200" including an embodiment of address comparator 230' and of address storage 240' for operating with a plurality of simultaneously operating transmitter modules, such as transmitters 100A, 100B, . . . . Blocks in FIG. 9 that are the same as blocks in FIG. 4 and described above are shown in phantom and are identified by the same numeric designation as in FIG. 4. Address storage 240' includes addressable registers or memory 242 in which are stored the preselected fixed coded identification values corresponding to the preselected coded identification value of each of the plurality of transmitter modules 100A, 100B, . . . that are operably associated with receiver 200". Address selector 244 repetitively generates a sequence of addresses including the addresses of all the registers of addressable register 242 within a time period that is much shorter than the interval between successive transmissions of each transmitter module. For example, with the transmitters repeating their transmission about every four seconds, it is preferred that address selector 244 generate one complete sequence of addresses in less than 50 milliseconds. Thus the complete set of preselected stored coded values are applied to one input of coded value comparator 232 in less than 50 milliseconds whereby the received coded identification value received and decoded at the output of shift register 220 and applied to the other input of coded value comparator 232 is compared to each one of the stored coded values of the set thereof stored in addressable register 242.

Comparator 230' includes a latch circuit 234 having an addressable latch corresponding to each register in addressable register 242 and that is addressed by the same address value generated by address selector 244 to address register 242. When there is a match at the inputs of coded value comparator 232 between the received coded value and the then produced stored coded value, the occurrence of the match is stored by setting the designated corresponding latch in latch circuit 234. If received coded identification values corresponding to all of the stored fixed coded values are received and properly decoded, then all of the latches in latch circuit 234 will be set, thereby making a "true" condition at the inputs of AND gate 236 causing its output to become "true". This "true" from AND gate 236 signal resets receive timer 250 as described above in relation to FIGS. 4 and 5 to prevent the alarm from sounding, and also activates reset circuit 238 to reset all the latches of latch circuit 234 so that the comparison sequence of received coded identification values to the set of stored fixed coded values begins again. If all of the preselected received coded values are not received, then all of the latches in latch circuit 234 are not set, the output of AND gate 236 does not become "true", and receive timer 250 times out to sound the alarm 260. The output of receive timer 250 is also applied to hold reset circuit 238 in the set condition thereby to prevent it from resetting latch circuit 236. If latch circuit 236 were allowed to be reset after an alarm condition is detected, alarm 260 could thereafter become turned off if all of the preselected coded identification values are thereafter received and properly decoded, and it is preferred that a manual action by the user of receiver module 200" be required to reset the alarm 260 once it has sounded.

Figure 10:
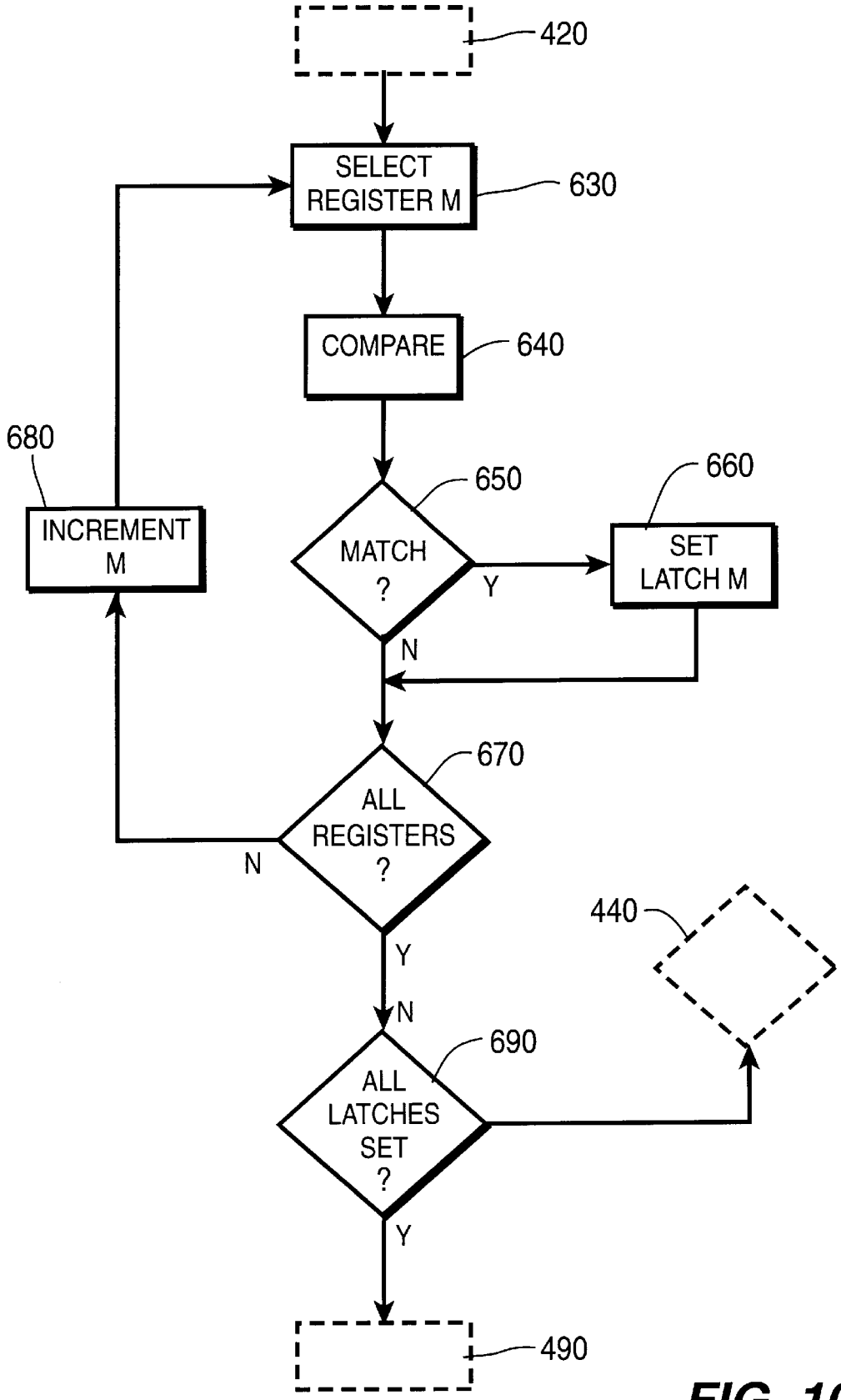
FIG. 10 is a signal flow diagram relating to the alternative embodiment of FIG. 9.

FIG. 10 is a signal flow diagram relating to the embodiment of the portion of receiver module 200" described above in relation to FIG. 9. In the diagram of FIG. 10, blocks 630 through 690 replace blocks 430, 460, 470 and 480 of FIG. 6 above, and those blocks common to both FIGS. 6 and 10 and described above are shown in phantom and are identified by the same numeric designation as in FIG. 6. After being initialized upon turn-on, an address of an addressable register 242 containing a stored coded value is selected 630 to produce that coded value of the set of stored coded values for comparison 640 to a coded value received 420 from a transmitter. If there is a match at comparison 640 of the received coded value and the stored coded value then produced, then decision block 650 is exited by the "no" path and the latch 234 corresponding to that selected 630 address is set 660. Thereafter, irrespective of whether decision block 650 was exited by the "yes" path or by the "no" path, decision block 670 determines whether all of the registers 242 containing stored coded values have been addressed 630. If all have not been addressed, decision block 670 is exited via the "no" path and the address counter is incremented 680 so that the next address in the sequence is selected 630. If all registers have been addressed, then decision block 670 is exited by the "yes" path and decision block 690 determines whether all of the latches have been set 660. If all of the latches have not been set 660, decision block 690 is exited by the "no" path and the process proceeds to receive timer decision block 440 described above in relation to FIG. 6. If all of the latches have been set 660, then all of the tethered coded articles have been accounted for and decision block 690 is exited by the "yes" path to reset the receive timer 490 also described above in relation to FIG. 6.

Accordingly, it is seen that the alarm 260 will sound unless all of the plurality of tethered coded articles 100A, 100B, . . . have been accounted for within the receive timer 250 interval by their respective preselected coded identification values having been (1) received and properly decoded by receiver module 200" and (2) compared and found to match one of the stored fixed coded identification values of the set of fixed coded identification values stored therein.

While the present invention has been described in terms of the foregoing exemplary embodiments, variations within the scope and spirit of the present invention as defined by the claims following will be apparent to those skilled in the art. For example, where receiver module 200, 200' is implemented using a microprocessor such as a type 6805 microprocessor available from Motorola, Inc. of Scottsdale, Ariz., the microprocessor's internal wake-up function and sleep (watch dog) functions may be employed to implement wake-up circuit 272 and watch dog circuit 274. A microprocessor implementation is preferred, for example, where plural transmission modules 100A, 100B are to be monitored by a single receiver module 200. In such case, the microprocessor 280 is easily programmed to perform the necessary comparisons and tests such as those depicted in the flow diagram of FIGS. 6 and 10 and described in relation thereto.

While the particular encoder employed in the embodiment of FIG. 7 produces a coded value in pulse-width modulated serial-bit format alternative forms of encoding or modulation, such as frequency shift keying (FSK), bit phase shift keying (BPSK), Manchester coding or other conventional coding schemes may be employed. Other numbers and apportionments of the coded value bits may be employed. For example, if 8 bits of a 12-bit coded value are employed for the address portion and 4 bits for the data portion identifying a particular one of the plural transmitter modules 100A, 100B used with a particular receiver module 200, then up to sixteen transmitter modules may be monitored by one receiver module 200.

RF transmitter 140 of transmitter module 100 may employ an L-C tuned RF oscillator/transmitter or a surface acoustic wave (SAW) resonator tuned RF oscillator transmitter or other type of transmitter. Similarly, the RF receiver 210 of receiver module 200 could employ a SAW resonator RF receiver or other receiver circuit in place of an L-C tuned RF receiver. Operation of the transmitter and receiver at a higher frequency would allow for smaller antennas and for smaller transmitter and receiver modules, and would tend to reduce unwanted absorption of the transmitted RF signals by people and other objects coming between the transmitter and the receiver.

While the foregoing embodiments have been described in terms of a radio frequency transmission between the transmitter module 100 and receiver module 200, there are applications, such as maintaining security for a number of pieces of office equipment within a room, wherein an infrared transmitter-receiver set would be satisfactory in place of an RF transmitter-RF receiver set, including applications requiring communicating between one or more transmitter modules and a receiver module. Similarly, address storage 110, 240 may be implemented with read only memories (ROM) or programmable read only memories (PROM) as is known to those of skill in the art, so long as the coded values stored therein for receiver modules and transmitter modules associated with each other are the same values.

Alarm 260 may produce an audible alarm, a visual alarm or a tactile alarm, or may activate a security device or disable a device such as a computer, copier or other equipment to be protected. Conventional loud speakers, piezoelectric devices, lamps, light-emitting devices, electromechanical vibrators and the like may be employed for this purpose, as may anti-theft devices such as smoke dispensers and colored ink dispensers. The phrase "sound an alarm" as used herein may refer to any of the foregoing or other types of alarm devices, including home and facility alarms, surveillance cameras, telephone dialers and so forth, and not necessarily to an audible alarm.

With respect to the embodiment of FIGS. 9 and 10, the respective coded values of the respective coded articles (i.e. transmitters) 100A, 100B, . . . , and the corresponding fixed coded values stored in receiver module 200", may be selected with varying formats so long as the same format is selected for any particular set of associated transmitters and receiver that are to operate together. Each transmitter 100A, 100B, . . . may have a completely different preselected coded value and those coded values are then fixed when stored in the receiver module 200". Alternatively, as described above, the set of transmitters may have a preselected coded value that comprises an address portion that is the same for each transmitter in a set and a data word portion that is unique to each particular one of the transmitters. In the latter case, the receiver is simplified because only one address portion need be stored and only the data word portion need be stored in addressable registers.

What is claimed is:

1. Coded article detection apparatus comprising:

at least first and second coded articles respectively transmitting first and second preselected identification values; and a receiver for receiving said preselected identification values including:

a non-volatile memory for storing first and second fixed predetermined values:

a detector generating a first signal when said first preselected identification value corresponds to said first fixed predetermined value and said second preselected identification value corresponds to said second fixed predetermined value; and a timer responsive to the first signal to generate an alarm when the first signal is not generated for a predetermined time interval.

2. The apparatus of claim 1 wherein each of said coded articles comprises:

a memory for storing said preselected identification value; and a radio frequency transmitter coupled to said memory for said transmitting said preselected identification value.

3. The apparatus of claim 2 wherein each of said coded articles further comprises an encoder for said coupling of said memory to said radio frequency transmitter.

4. The apparatus of claim 3 wherein said encoder changes said preselected identification value from a parallel bit format to a serial bit format.

5. The apparatus of claim 2 wherein each of said coded articles further comprises a timer for causing said radio frequency transmitter to transmit said preselected identification value during a portion of each of a sequence of time intervals.

6. The apparatus of claim 1 wherein said first and second fixed predetermined values are in parallel bit format and wherein said detector further includes a decoder, which decoder changes said preselected identification values to parallel bit format.

7. The apparatus of claim 1 wherein said timer generates said alarm if said timer is not reset by said first signal within said predetermined time interval.

8. The apparatus of claim 1 wherein said predetermined time interval of said timer is greater than a time necessary for each of said coded articles to respectively transmit said first and second preselected identification values N times, where N is an integer greater than one.

9. The apparatus of claim 1 wherein said non-volatile memory includes an addressable memory, and wherein said detector comprises an addressable latch for storing when said first preselected identification value corresponds to said first fixed predetermined value and when said second preselected identification value corresponds to said second fixed predetermined value; and means addressing said addressable memory and said addressable latch.

10. The apparatus of claim 9 wherein said detector further comprises means coupled to said addressable latch for generating said first signal when said first preselected identification value corresponds to said first fixed predetermined value and when said second preselected identification value corresponds to said second fixed predetermined value.

11. Coded article detection apparatus comprising:

a plurality of coded articles each transmitting a respective preselected identification value; and a receiver for receiving said respective preselected identification values including:

a detector generating a first signal when one of said respective preselected identification values corresponds to one of a set of fixed predetermined values;

a latch responsive to said first signal to generate a second signal when said first signal has been generated in response to every one of the fixed predetermined values of said set of fixed predetermined values; and a timer responsive to the second signal to generate an alarm when the second signal is not generated for a predetermined time interval.

12. The apparatus of claim 11 wherein said receiver further comprises a non-volatile memory for storing said set of fixed predetermined values.

13. The apparatus of claim 12 wherein said set of fixed predetermined values is in parallel bit format and wherein said detector further includes a decoder, which decoder changes said respective preselected identification values to parallel bit format.

14. The apparatus of claim 11 wherein said timer generates said alarm if said timer is not reset by said second signal within said predetermined time interval.

15. The apparatus of claim 11 wherein said predetermined time interval of said timer is greater than a time necessary for each one of said plurality of coded articles to transmit said respective preselected identification value N times, where N is an integer greater than one.

16. Coded article detection apparatus comprising:

a set of coded articles each including a transmitter for transmitting a respective identification signal including a preselected coded value, wherein the set of coded articles transmits a set of preselected coded values; and detection apparatus including:

a receiver for receiving identification signals, a comparator for comparing the coded value of each said received identification signal to a set of fixed predetermined values, wherein said set of fixed predetermined values are preselected to correspond to the set of preselected coded values, a detector for detecting received identification signals, wherein said detector is coupled to said receiver to enable said comparator in response to receiving an identification signal irrespective of the coded value included therein, said comparator once enabled then comparing the coded value of each said received identification signal to said set of fixed predetermined values, and a first timer coupled to said comparator for generating an alarm when the set of coded values of said received identification signals differs from said set of fixed predetermined values for a given first time interval.

17. The apparatus of claim 16 wherein each coded article of said set of coded articles further includes:

a memory for storing said respective preselected coded value, and an encoder for placing said respective preselected coded value in serial bit format.

18. The apparatus of claim 16 wherein each coded article of said set of coded articles further includes a second timer for determining a second time interval, said second timer being coupled to said transmitter of said each coded article for causing said transmitter to transmit its respective identification signal once during each said second time interval.

19. The apparatus of claim 16 wherein said first timer determines said given first time interval to be greater than a time required for each of said transmitters to transmit its respective identification signal N times, where N is an integer greater than one.

20. The apparatus of claim 16 wherein each fixed predetermined value of said set of fixed predetermined values is in parallel bit format and wherein said comparator includes a decoder for converting the coded value of said received identification signal to parallel bit format.

21. The apparatus of claim 16 wherein said comparator comprises:

an addressable memory storing said set of fixed reference values;

an addressable latch storing an indication when a coded value of the received identification signals corresponds to one of the set of fixed predetermined values; and means addressing said addressable memory and said addressable latch.

22. The apparatus of claim 21 wherein said comparator further comprises means coupled to said addressable latch and to said first timer for signaling said first timer when said indications stored in said addressable latch correspond to said set of fixed predetermined values.

23. A transmitter-receiver set comprising:

a transmitter memory containing a preselected coded identification value stored therein;

a transmitter for transmitting said preselected coded identification value during a portion of each one of a sequence of time intervals; and a receiver for receiving said preselected coded identification value when said transmitter is within transmission range of said receiver;

a receiver memory containing a fixed reference value stored therein;

a comparator for detecting when said preselected coded identification value corresponds to said fixed reference value;

a receiver timer responsive to said comparator to generate an alarm when said preselected coded identification value does not correspond to said fixed reference value for a predetermined time greater than said time interval; and a wake-up circuit responsive to the receiver receiving a coded identification value to connect said comparator to a source of electrical potential.

24. The transmitter-receiver set of claim 23 wherein said preselected coded identification value is a digital word including a plurality of bits.

25. The transmitter-receiver set of claim 24 wherein said transmitter includes an encoder to convert said digital word from a parallel bit format to a serial bit format.

26. The transmitter-receiver set of claim 24 wherein said receiver includes a decoder to convert said digital word from a serial bit format to a parallel bit format.

27. The transmitter-receiver set of claim 23 wherein said transmitter further includes a transmitter timer for generating said time intervals.

28. The transmitter-receiver set of claim 27 wherein said transmitter is responsive to said transmitter timer to activate said transmitter to transmit said preselected coded identification signal.

29. The transmitter-receiver set of claim 23 wherein the predetermined time associated with said receiver timer is greater than a plurality of said time intervals of said transmitter.

30. A method of detecting absence of one of a set of articles each of which periodically transmits a preselected coded identification value comprising:

receiving each transmitted coded identification value;

comparing each received coded identification value to a set of fixed reference values, wherein said set of fixed reference values is preselected to correspond to said preselected coded identification values;

generating an indication of correspondence when the received coded identification value corresponds to one of the set of fixed reference values;

storing the indication of correspondence;

determining when the stored indications of correspondence correspond to the set of fixed reference values;

timing up to a predetermined time period;

restarting said timing when the stored indications of correspondence are determined to correspond to the set of fixed reference values; and sounding an alarm when said timing reaches said predetermined time period, whereby said alarm is sounded when said timing reaches said predetermined time period before correspondence of the stored indications to the set of fixed reference values is determined.

31. The method of claim 30 wherein said generating an indication of correspondence comprises:

converting at least one of said received identification value and said fixed reference value into like format with the other of said received identification value and said fixed reference value.

32. The method of claim 31 wherein said generating an indication of correspondence further comprises:

comparing the converted at least one of said received identification value and said fixed reference value to the other of said received identification value and said fixed reference value to generate said indication of correspondence.

33. The method of claim 30 wherein said comparing includes addressing an addressable memory to produce said set of fixed reference values.

34. The method of claim 30 wherein said comparing includes repeatedly addressing an addressable memory to produce said set of fixed reference values a plurality of times within said predetermined time period.

* * * * *